US006470636B1

(12) United States Patent
Rose

(10) Patent No.: US 6,470,636 B1
(45) Date of Patent: Oct. 29, 2002

(54) DETENSIONING APPARATUS FOR RELEASING A CHUCK ON A PRESTRESSED STRAND

(75) Inventor: Dallas R. Rose, 1185 W. Kelly La., Tempe, AZ (US) 85284

(73) Assignee: Dallas R. Rose, Temple, AZ (US)

( * ) Notice: Subject to any disclaimer, the term of this patent is extended or adjusted under 35 U.S.C. 154(b) by 0 days.

(21) Appl. No.: 09/632,881

(22) Filed: Aug. 7, 2000

(51) Int. Cl.[7] ..... E04C 5/12; E04G 21/12

(52) U.S. Cl. ..... 52/223.1; 52/223.14; 52/223.13; 52/223.6; 52/DIG. 4

(58) Field of Search ..... 52/223.14, 223.1, 52/223.6, 223.7, 223.13, DIG. 4, 749.1; 264/228, 229; 29/452

(56) References Cited

U.S. PATENT DOCUMENTS

| | | | | | |
|---|---|---|---|---|---|
| 2,153,741 | A | * | 4/1939 | Cobi | 52/223.13 |
| 2,245,316 | A | | 6/1941 | Amsler | |
| 2,871,554 | A | * | 2/1959 | Siegfried | 52/223.14 |
| 3,376,615 | A | * | 4/1968 | Heckman | 52/223.14 |
| 3,478,396 | A | | 11/1969 | Drouillard | |
| 3,524,228 | A | | 8/1970 | Kelly | |
| 3,701,509 | A | * | 10/1972 | Stinton | 254/29 A |
| 3,703,748 | A | | 11/1972 | Kelly | |
| 3,762,027 | A | | 10/1973 | Burtelson | |
| 3,778,869 | A | | 12/1973 | Andrews | |
| 3,795,949 | A | * | 3/1974 | Shorter | 24/115 R |
| RE27,954 | E | | 4/1974 | Kelly | |
| 3,858,991 | A | * | 1/1975 | Burtelson | 403/194 |
| 3,895,879 | A | * | 7/1975 | Burtelson | 403/369 |
| 3,910,546 | A | | 10/1975 | Connors | |
| 3,912,406 | A | | 10/1975 | McGrath | |
| 3,965,542 | A | | 6/1976 | Gregory | |
| 4,114,242 | A | | 9/1978 | Luthi | |
| 4,124,321 | A | * | 11/1978 | Hutchins | 403/167 |
| 4,192,215 | A | * | 3/1980 | Hymans | 85/36 |
| 4,454,633 | A | | 6/1984 | de la Fuente et al. | |
| 4,604,003 | A | * | 8/1986 | Francoeur et al. | 405/256 |
| 4,878,327 | A | * | 11/1989 | Nutzel et al. | 52/230 |
| 5,347,777 | A | * | 9/1994 | Sudduth | 52/223.13 |
| 5,594,977 | A | | 1/1997 | McCallion | |
| 5,718,090 | A | * | 2/1998 | Hwang | 52/223.14 |
| 5,939,003 | A | * | 8/1999 | Crigler et al. | 264/228 |

FOREIGN PATENT DOCUMENTS

| | | | | |
|---|---|---|---|---|
| DK | 75024 | * | 11/1952 | 52/223.14 |
| DK | 2262120 | * | 6/1974 | 52/223.13 |
| GB | 1394362 | * | 5/1975 | 52/223.14 |
| GB | 2106947 | * | 4/1983 | 52/223.13 |
| JP | 404016675 | * | 1/1992 | 52/223.13 |
| SU | 1434059 | * | 10/1988 | 52/223.13 |

OTHER PUBLICATIONS

PCI Journal, Daniel P. Jenny Research Fellowship, *Investigation of Standardized Tests to Measure the Bond Performance of Prestressing Strand*, Jul.–Aug. 1997, pp. 56–80.

* cited by examiner

*Primary Examiner*—Lanna Mai
*Assistant Examiner*—Phi Dieu Tran A
(74) *Attorney, Agent, or Firm*—Dick and Harris

(57) ABSTRACT

An apparatus for detensioning prestressed strand, the hollow apparatus being capable of movement along a pre-tensioned strand, thus enabling the protrusion of the apparatus's separation device into the rear portion of the strand chuck barrel's inner conical surface. The preferred embodiment of the apparatus is comprised of an outer housing that includes a first aperture large enough to project over the outer surface of the strand chuck barrel, and a second aperture sized to overlap the housing, thus enabling the positioning of the separation device in close proximity to that of the chuck. The apparatus's attraction member induces separation of the chuck from the strand without manual manipulation, thereby enabling detensioning of the strand.

16 Claims, 6 Drawing Sheets

Two Types of Manufacturing Beds Used for Manufacture of Prestressed Concrete Products Type 1: Self-Stressing Prestress Casting Bed
Type 2: Abutment Anchorage Prestress Casting Bed DIAGRAM - A
Type 1. Self-Stressing Prestress Casting Bed

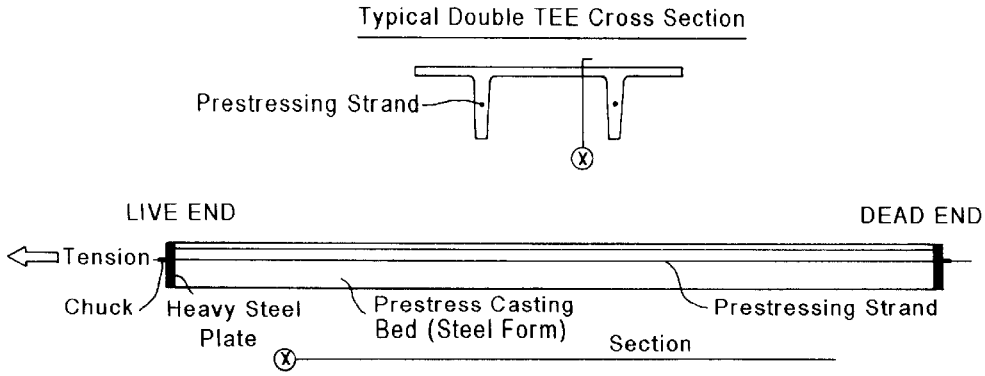

TYPE 2 – Abutment Anchorage Prestress Casting Bed

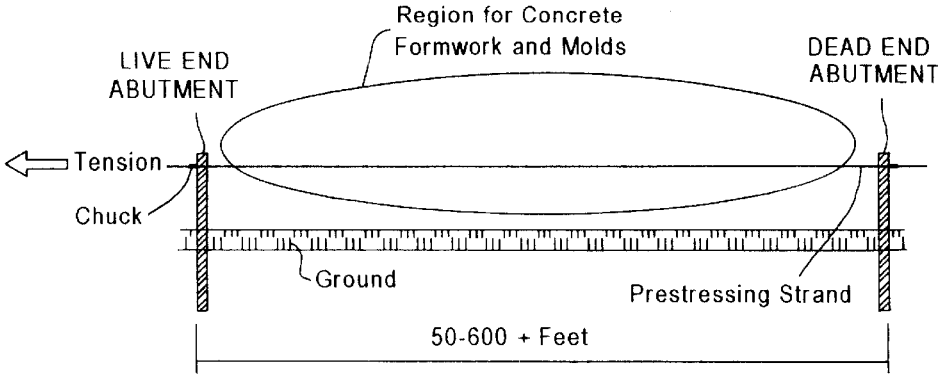

Diagram A illustrates two types of prestress concrete casting beds. The abutment anchorage bed is perhaps the most common type of the two. However, several types of prestressed concrete products are manufactured utilizing self–stressing beds. Please note in both cases tension will be sustained in the strand for times ranging from 2 to 12+ hours before concrete has been placed in the formwork and/or molds and allowed to cure.

Type 1 is a self stressing prestressing bed. Due to its rather large cross sectional size, the formwork itself can be used to resist the initial tensioning force before concrete has been cast into the formwork.

Type 2 is a abutment anchorage prestress bed. This bed utilizes large abutments cantilevering up from the earth. The abutments are completely separate from the casting forms and/or molds.

FIG. 13

The Way in Which the Detensioning Device Operates

DIAGRAM – B

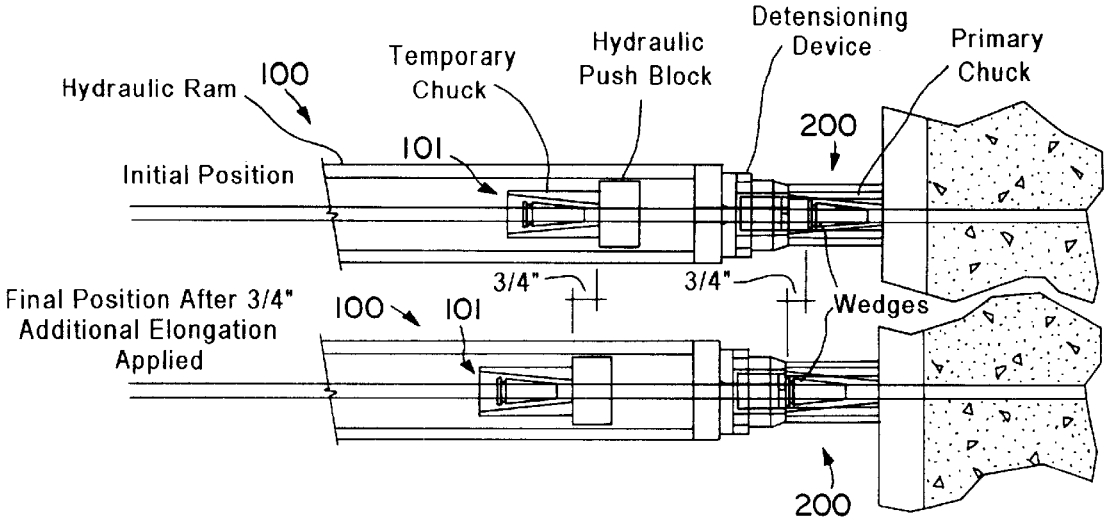

With the hydraulic ram attached to the temporary chuck and the initial tension brought back up in the strand, the strand is further elongated approximately 3/4 inch. In doing so, the wedges are drawn toward the magnets contained in the inner housing of the detensioning device. The magnets hold/grip the wedges with the force necessary to overcome the frictional force existing between the teeth of the wedges and the teethmark left in the strand when the strand tries to slide relative to the wedges. Thereby allowing the strand to slide through the wedges and relieve the tension.

FIG. 14

DETENSIONING APPARATUS FOR RELEASING A CHUCK ON A PRESTRESSED STRAND

BACKGROUND OF THE INVENTION

1. Field of the Invention

The present invention relates to a detensioning apparatus and method for the repositioning of a clamp on a prestressed strand.

2. The Prior Art

The use of prestressed concrete is a common and vital construction technique with which high strength structures are formed. Prestressed concrete is an often preferred alternative to reinforced concrete for its increased strength and improved durability with respect to exposure to natural elements, such as moisture, freezing, thawing, and corrosion, and in particular is more resilient to cracking.

Formation of prestressed concrete structures involves the use of a form or "casting bed". As shown in FIG. 13, the casting bed may be categorized as either a self-stressing prestress casting bed (Type 1—Diagram A) or an abutment anchorage prestress casting bed (Type 2—Diagram B). Please note that any dimensions or numerical values shown in FIG. 13 are given by way of example, and are not intended to limit the invention, as described elsewhere herein.

The Type 1 self-stressing prestress casting bed of Diagram A is formed typically from a steel form, that is provided with heavy steel plates positioned at its ends. One plate is the "dead" end and the other is the "live" end, at which manipulation of the prestressing wires is accomplished. The Type 2 abutment anchorage prestress casting bed employs abutments embedded in the ground, to form the ends of the casting form. Again, one abutment acts as the dead end and the opposite abutment acts as the live end.

Steel strands (each comprising one or more wires) are passed through the steel plates or abutments, to extend through the form where the concrete is to be poured. The steel strands are typically tensioned for times ranging from 2 to 12+ hours, prior to pouring the concrete. The strands are secured in a stressed position by placing wedge-shaped steel jaw(s) around the circumference of each strand. The jaws forms a chuck that engages a conical bore of a strand chuck barrel, which is secured against the live end of the casting bed, in such a manner that the pulling force of the strand on the chuck is translated into compressive pressure on the strand to bind the chuck thereto. Tension may be applied by placing a second, "temporary" chuck on each strand, to the outside of the respective "permanent" chucks. Tension may be applied by a hydraulic ram, pushing against the temporary chuck, relative to the live end, to stretch the strand. The "permanent" chuck is then placed against or extremely close to the outer surface of the live end. The tension exerted by the hydraulic ram is released, enabling the strand to contract a small amount, sufficient to cause the jaws in the "permanent" chuck to engage the strand and be pulled tightly against the strand chuck barrel. The amount by which each strand is allowed to recover is less than the amount by which each strand was originally stretched, so that tension remains, pulling the "permanent" chucks against the live end.

After concrete is poured into the pre-cast concrete form structure, the concrete is allowed to cure. The "permanent" chucks are then removed from the strands.

On certain occasions, the stressed strands must be moved for realignment, or the amount of tension must be reduced, before the concrete is placed in the casting bed. Typically, the procedure of detensioning a stressed strand involves the practice of over-tensioning the strand; thereby stretching it and removing pressure from the steel chuck. In so doing, as a result of the high compressive pressures applied thereto, the chuck often binds to the strand chuck barrel's conical inner surface and subsequently to the prestressed strand. In the prior art chuck removal involves manual manipulation of the chuck before tension on the strand is released.

This method of detensioning a stressed strand is exceptionally dangerous. During the time at which the chucks must be removed, the strand is under extreme tension. Consequently, any failure of the strand while a worker is manually removing the chuck could potentially result in severe injury or death to a worker, or other damage. Furthermore, when the one or more jaws forming the chuck bind to the strand, the substantial manual manipulation by a worker required breaking the chuck free further increases the danger. Accordingly, significant danger, and effort became associated with the detensioning procedure.

U.S. Pat. No. 3,912,496 discloses a gripping device in which a pull tube extends outwardly from the device and allows for the engagement of a prying tool. The force exerted by a worker on the prying tool directly results in the axial movement of the chuck, thereby releasing the strand from the chuck's grip. However, this invention requires the positioning of the worker in close proximity to the strand while it is under extreme tension, thereby increasing the potential for serious bodily harm if strand failure were to occur while the worker manually pried the chuck out from the strand chuck barrel.

U.S. Pat. No. 3,478,396 teaches a gripping device that incorporates an externally threaded strand chuck barrel, in which a chuck fit into the conical bore, and a matching internally threaded collar. The threaded housing and collar allows for the re-tensioning of the strand by a worker manually rotating the threaded collar with respect to the threaded bushing.

U.S. Pat. No 5,594,977 describes the combination of engagement of threaded members that, upon rotation, forces a pull tube to axially withdraw the chuck from the conical bore thereby resulting in the release of the strand from the chuck's grip. These detensioning devices however are permanently integrated into the strand chuck housing, resulting in not only more complex and expensive devices, but also potential corrosion of the threaded members, thereby potentially rendering the invention difficult to use or requiring additional maintenance. Furthermore, the worker must manually manipulate these devices while the strand is under full load, thereby increasing the risk of potential physical harm to the worker from strand failure.

U.S. Pat. No. 3,910,546, and U.S. Pat. No. 3,965,542, both disclose a gripper device incorporating a chuck that can be physically pulled back by a pull rod, which engages channels in the rear edge of the chuck. Neither of these devices can be used in conjunction with a member that passes completely through the channel formed by the chuck, as would be the case with a tensioning strand in actual prestressed concrete construction.

U.S. Pat. No. 3,778,869 teaches the use of a detensioning screw that can be turned to advance or withdraw a pushplate against cylindrical lugs bearing outwardly against the chuck through which the strands pass. These lugs in turn force the chuck rearward from the conical bore, and thereby release the strand from them. However the detensioning aspect is permanently integrated into this device and therefore may not be removed for the purpose of detensioning other chucks.

U.S. Pat. No. 2,245,316 discloses an apparatus that facilitates the removal of a clamping chuck in tensile testing machinery. The angles of the conical bore of the strand chuck barrel are significantly larger than that of the chuck's outer surface so that when the force on a strand passing through the chuck is released, the radial forces exerted by the chuck forces the body with the greater taper, the strand chuck barrel, to be pushed away, whereby the strand is released from the chuck. However, this device does not consider the situation where an extended period of compressive pressure has bound the chuck to the inner conical surface of the strand chuck barrel and the prestressed strand.

U.S. Pat. No. 4,114,242 discloses an apparatus requiring physical interlocking between the chuck and an external tube. The apparatus involves a tube having an initial flare that engages with a groove on the inside surface of the chuck, and a second flare engaging a mounting plate, which, after the first flare is engaged with the chuck, is pulled rearward to remove the chuck from the bore. This device appears to require a large and substantial apparatus that achieves chuck removal by physical engagement.

Similar to 4,114,242, U.S. Pat. No. 4,454,633 incorporates a latching mechanism for engaging, and subsequently tipping the chuck along their rear surface, thereby releasing an array of prestressed strands from the chuck's gripping surface. Again, this device requires the physical engagement of the chuck and appears to require a comparatively large and complex mechanism.

It would be desirable to provide a simple, inexpensive, re-useable, and efficient apparatus that allows for the detensioning of prestressed strand without the potential hazards associated with manual chuck manipulation.

It would further be desirable to provide a reliable means for inducing chuck movement, and subsequent release of a prestressed strand from the chuck's compressive force, without direct physical engagement or manual manipulation of said chuck.

It would also be desirable to provide a simple compact design to allow for the engagement of the apparatus in a grid of strand chuck housings without interference from neighboring strand chuck barrels.

These and other desirable characteristics of the present invention will become apparent in view of the present specification, including the claims, and drawings.

SUMMARY OF INVENTION

The proposed invention is directed to an improved apparatus for detensioning a stressed member and facilitating subsequent repositioning or removal of the chuck from the strand, wherein a worker need not directly handle or manipulate the chuck during the chuck removal or repositioning process. As in the prior art, a strand to be de-tensioned is first over-tensioned, thereby releasing the pressure from the chuck. However, with the proposed invention, an attraction member within the detensioning sleeve induces separation of the jaws of the chuck from the strand. Removal of the chuck is quick, easy, and does not require dangerous manual manipulation near the over-tensioned strand.

The present invention is directed, in part, to a detensioning apparatus, for use during a process of fabricating prestressed concrete, during which process a region in which concrete is to be poured includes at least two opposing abutments, one or more prestressing strands are run between opposing abutments, tensioned and held in tension, by clamps that engage the strands and bear against the opposing abutments, while concrete is poured into the region and cured, wherein each clamp includes a chuck having one or more jaws, and a surrounding strand chuck barrel, configured so that tension in the strand, between opposing abutments, prompts the chuck to be pressed against the strand to frictionally engage the strand.

The detensioning apparatus preferably comprises a collar member, operably configured to be placed onto a prestressing strand, that has been tensioned and to which a strand clamp has been affixed. The collar member has a central bore, a first portion of which is operably configured to insertingly receive a strand chuck barrel, and a second portion of which is provided with a smaller diameter than the first portion, defining a shoulder configured to bear against at least a portion of an end of a strand chuck barrel.

A separation member housing is operably configured to be insertingly received in the second portion of the central bore of the collar member. At least one separation member is supported on the separation member housing, and operably configured for separating a chuck from a prestressing strand, after the tension in the strand causing the chuck to be prompted against the strand is balanced.

The collar member is operably configured to be slid onto a free end of a prestressing strand, to a position surrounding a strand chuck barrel that is holding a strand in tension, such that upon exertion of tension between a free end of the strand and a strand chuck barrel, the collar member bears against the strand chuck barrel and prevents its movement, so that additional tension in the strand will cause the chuck to be drawn toward the at least one separation member contained within the collar member.

When the chuck of the strand clamp is fabricated at least in part, from magnetically responsive material, the at least one separation member preferably comprises at least one magnetic member mounted on the separation member housing, so as to exert magnetic force on the one or more jaws, when the additional tension is applied to the strand the one or more jaws move with the strand until they come into contact with the at least one separation member, the at least one separation member holding the one or more jaws, allowing the strand to slide through the one or more jaws, thereby detensioning the strand.

In a preferred embodiment of the invention, the separation member housing comprises a first cylindrical member, having a central bore, for receiving a prestressing strand. The first cylindrical member has a diameter less than the diameter of the second portion of the central bore of the collar member, to enable insertion of the first cylindrical member into the second portion of the central bore of the collar member. The first cylindrical member further has a first end operably configured to support the at least one separation member, at a position proximate an outer end of the first portion of the central bore of the collar member. The first end of the first cylindrical member may be provided with at least one cavity operably configured to receive the at least one separation member.

The separation member housing preferably comprises a second cylindrical member, having a central bore operably configured to receive the first cylindrical member, the second cylindrical member having an outer diameter operably configured to enable, at least a first end portion of the second cylindrical member to be insertingly received, at least in part, in the second portion of the central bore of the collar member.

The separation member housing further preferably comprises a first attachment flange, operably connected to a second end of the second cylindrical member, and having an outer diameter greater than the diameter of the second portion of the central bore of the collar member, the attachment flange further having a central bore for enabling the passage therethrough of a prestressing strand.

The detensioning apparatus further preferably comprises a second attachment flange, operably mounted on and having an outer diameter greater than, the collar member, for enabling abutment of the first attachment flange to the second attachment flange, upon insertion of the separation member housing into the second portion of the central bore of the collar member, whereupon affixation of the second attachment flange to the first attachment flange affixes the separation member housing to the collar member.

In a preferred embodiment of the invention, at least a portion of an outer surface of the collar member may be provided with flattened sides, for facilitating placement of the detensioning device in position over a strand chuck barrel and against an abutment.

The present invention is also directed to a method for detensioning a prestressing strand, for use during a process of fabricating prestressed concrete, during which process a region in which concrete is to be poured includes at least two opposing abutments, one or more prestressing strands are run between opposing abutments, tensioned and held in tension, by clamps that engage the strands and bear against the opposing abutments, while concrete is poured into the region and cured, wherein each clamp includes a chuck having from one or more jaws and a surrounding strand chuck barrel, configured so that tension in the strand, between opposing abutments, prompts the chuck to be pressed against the strand to frictionally engage the strand.

The method comprises the steps of:

positioning a detensioning apparatus onto a prestressing strand, which strand has been tensioned and to which a strand clamp has been affixed, the detensioning apparatus including a collar member, operably configured to be placed onto a prestressing strand, that has been tensioned and to which a strand clamp has been affixed, the collar member having a central bore, a first portion of which is operably configured to insertingly receive a strand chuck barrel, and a second portion of which is provided with a smaller diameter than the first portion, defining a shoulder configured to bear against at least a portion of an end of a strand chuck barrel, a separation member housing, operably configured to be insertingly received in the second portion of the central bore of the collar member, at least one separation member supported on the separation member housing, and operably configured for separating a chuck from a prestressing strand, after the tension in the strand causing the chuck to be prompted against the strand is balanced, the collar member being operably configured to be slid onto a free end of a prestressing strand, to a position surrounding a strand chuck barrel that is holding a strand in tension, such that upon exertion of tension between a free end of the strand and a strand chuck barrel, the collar member bears against the strand chuck barrel and prevents its movement, so that additional tension in the strand will cause the chuck to be drawn toward the at least one separation member contained within the collar member;

sliding the collar member onto a free end of a prestressing strand, to a position surrounding a strand chuck barrel, and affixing the detensioning apparatus against an abutment;

pulling on a free end of the prestressing strand, until the tension in the strand that causes the chuck to be prompted against the prestressing strand has been balanced, applying additional tension in the strand, to cause the chuck to be drawn toward the at least one separation member contained within the collar member;

whereupon the at least one separation member causes the chuck to become separated from the strand, to enable repositioning of the prestressing strand and/or the strand clamp.

When the chuck of the strand clamp is fabricated at least in part from magnetically responsive material, the method further preferably comprises the step of fabricating the at least one separation member as at least one magnetic member mounted on the separation member housing, so as to exert magnetic force on the one or more jaws, when the additional tension is applied to the strand the one or more jaws move with the strand until they come into contact with the at least one separation member, the at least one separation member holding the one or more jaws, allowing the strand to slide through the one or more jaws, thereby detensioning the strand.

The method further preferably comprises the step of fabricating the separation member housing as a first cylindrical member, having a central bore, for receiving a prestressing strand, the first cylindrical member having a diameter less than the diameter of the second portion of the central bore of the collar member, to enable insertion of the first cylindrical member into the second portion of the central bore of the collar member, the first cylindrical member further having a first end operably configured to support the at least one separation member, at a position proximate an outer end of the first portion of the central bore of the collar member.

The method further preferably comprises the step of providing the first end of the first cylindrical member with at least one cavity operably configured to receive the at least one separation member.

The method further preferably comprises the step of providing the separation member housing with a second cylindrical member, having a central bore operably configured to receive the first cylindrical member, the second cylindrical member having an outer diameter operably configured to enable at least a first end portion of the second cylindrical member to be insertingly received, at least in part, in the second portion of the central bore of the collar member.

The method further preferably comprises the step of operably connecting a first attachment flange, to a second end of the second cylindrical member, and having an outer diameter greater than the diameter of the second portion of the central bore of the collar member, the attachment flange further having a central bore for enabling the passage therethrough of a prestressing strand.

The method further preferably comprises the step of operably mounting a second attachment flange on the collar member, the second attachment flange having an outer diameter greater than the collar member, for enabling abutment of the first attachment flange to the second attachment flange, upon insertion of the separation member housing into the second portion of the central bore of the collar member, whereupon affixation of the second attachment flange to the first attachment flange affixes the separation member housing to the collar member.

The method further preferably comprises the step of providing at least a portion of an outer surface of the collar member with flattened sides, for facilitating clamping of the detensioning device in position over a strand chuck barrel and against an abutment.

BRIEF DESCRIPTION OF THE DRAWINGS

FIG. 13 is a schematic drawing of two examples of prestress casting beds.

FIG. 14 is a schematic illustration of the detensioning process, before and after application of the additional force required to obtain additional extension of the strands.

DETAILED DESCRIPTION OF THE DRAWINGS

Figure 1:
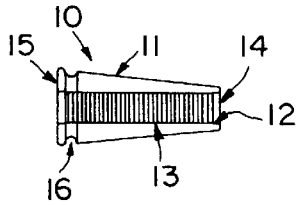
FIG. 1 is a longitudinal sectional view of the chuck.

While this invention is susceptible of embodiment in many different forms, there is shown in the drawings and will be described herein in detail, a preferred embodiment of the invention, with the understanding that the present disclosure is intended to be considered as an exemplification of the principles of the invention and is not intended to limit the invention to the embodiment illustrated.

The detensioning apparatus of the present invention, for use in prestressed strands is shown in FIGS. 1–12 and 14. Any component configuration or assembly which may be disclosed in the drawings is shown by way of example of the preferred embodiment of the invention, and the invention is not limited thereto, as one of ordinary skill in the art, having the present disclosure before them will be able to make modifications in the components of the apparatus without departing from the scope of the invention.

Figure 2:
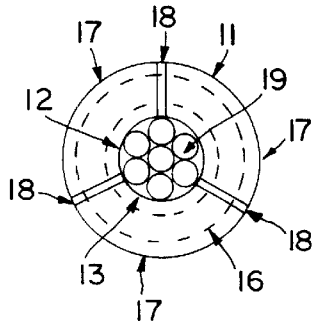
FIG. 2 is an end view of the chuck and it's jaws engaged with the strand.

FIG. 1 shows a longitudinal view of a chuck 10, preferably formed from a magnetically responsive material, having a conical outer surface 11, a cylindrical bore 12 including gripping teeth 13, a front portion 14, and a rear portion 15. An embodiment of the chuck shown in FIG. 1 also includes an O-ring groove 16. FIG. 2 displays a rear view of the chuck 10 engaged with a strand 19 running through the cylindrical bore 12. One or more individual jaws 17 are separated by a slots 18 which, when the conical outer surface 11 is subjected to an external compressive force, constrict to allow for the clamping of the cylindrical bore 12 onto the strand 19, thus forcing the gripping teeth 13 into engagement with said strand 19.

Figure 3:
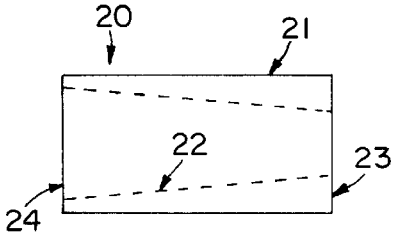
FIG. 3 is a longitudinal sectional view of the strand chuck barrel.

FIG. 3 displays the strand chuck barrel 20, comprising a outer surface 21, a conical inner surface 22 matching the taper of the chuck's 10 outer conical surface 11, a front portion 23, and a rear portion 24.

Figure 4:
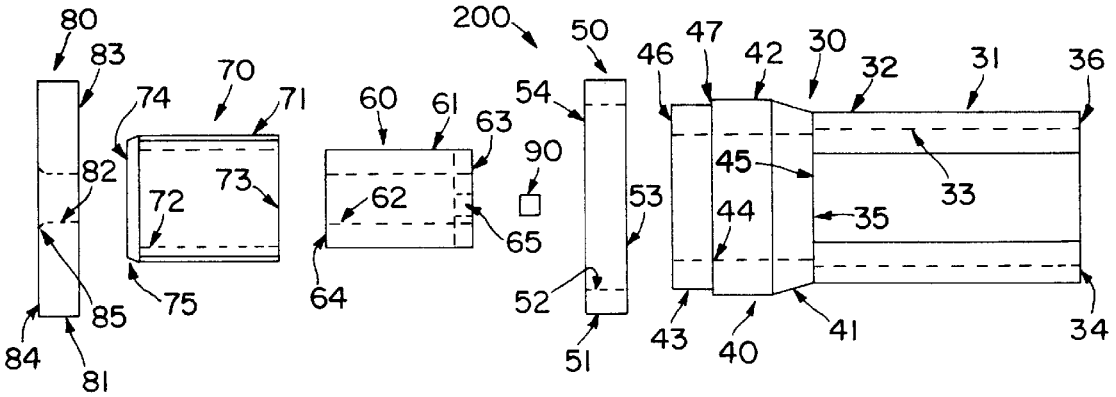
FIG. 4 is an exploded longitudinal view of a detensioning apparatus according to the preferred embodiment of the invention.

FIG. 4 is an exploded view of the detensioning apparatus 200 according to the preferred embodiment of the present invention for use in engaging the strand chuck barrel 20 and repositioning of the chuck 10 shown in FIGS. 1–3. The apparatus's outer housing 30 is comprised of a front sleeve 31 and a rear sleeve 40. The front sleeve 31 includes an outer surface 32, a first aperture 33, a front portion 34, and a rear portion 35. The first aperture 33 is large enough to engage and overlap the outer surface 21 of the strand chuck barrel 20. The rear sleeve 40 includes a chamfered surface 41 rising from the front sleeve 31 outer surface 32 to the rear sleeve 40 outer surface 42, a rear shoulder 47, a rear step 43, a second aperture 44 that is smaller than first aperture 33, a front portion 45, and a rear portion 46. Flange 50, having an outer surface 51, a front portion 53, and rear portion 54, has an aperture 52 sized to overlap rear step 43, thereby butting front portion 53 with rear shoulder 47.

Figure 5:
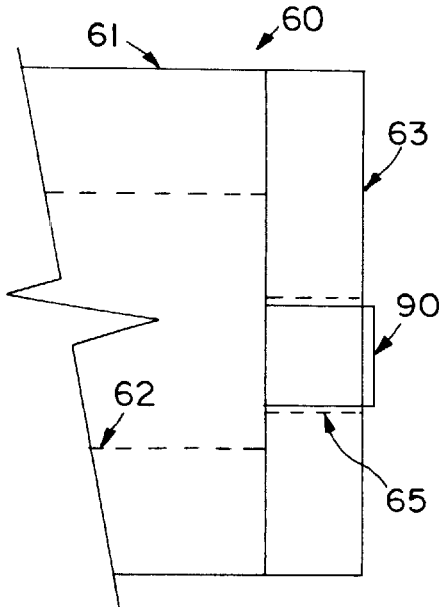
FIG. 5 is an enlarged view showing, for simplification, one magnet engaged in the preferred embodiment of the separation device sleeve.
Figure 6:
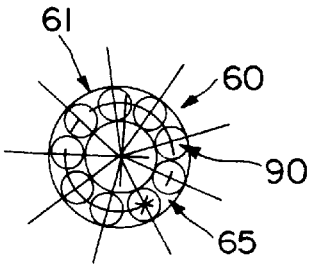
FIG. 6 is a frontal view of the separation device sleeve showing the orientation of the separation device in the preferred embodiment of the apparatus.

Sleeve 60 includes an outer surface 61, an inner surface 62, a front portion 63, and a rear portion 64. In the preferred embodiment of the invention separation device, preferably a magnet, 90 is positioned in a cavity 65 located on the front portion 63 of the sleeve 60. An enlarged view of the preferred embodiment of sleeve 60 is illustrated in FIG. 5, showing one magnet 90 imbedded within a cavity 65. While FIG. 4 and FIG. 5 display only one magnet 90 and cavity 65 for simplification of the illustrations, this invention is also capable of incorporating an array of magnets, imbedded in, or aligned against, the front portion 63 of the sleeve 60. FIG. 6 illustrates an example of such an array, where nine cavities 65 capable of accepting the separation device are equally spaced along the front portion 63 of the sleeve 60.

Additionally, the separation device may incorporate magnetic force through the use of rare earth magnets or electromagnets. Accordingly, the sleeve 60 of the preferred embodiment is constructed of aluminum. However, in an alternative embodiment the sleeve is wholly constructed from a rare earth magnet, thus removing the need for the addition of a separate separation device.

Figure 7:
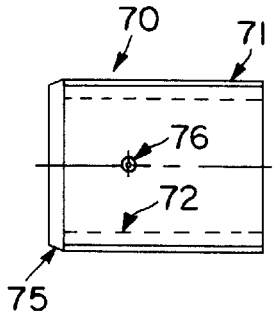
FIG. 7 is a longitudinal view of the separation device housing in the preferred embodiment of the apparatus.

FIG. 4 also illustrates the housing 70, being comprised of an outer surface 71 sized for engagement into the outer housing second aperture 44, an inner surface 72 large enough to overlap the outer surface 61 of the sleeve 60, a front portion 73, and a rear portion 74. In the preferred embodiment, the rear portion of the outer surface includes chamfer 75. In one embodiment of the invention the inner surface 72 of the housing 70 is sized to allow for a press fit with the outer surface 61 of the sleeve 60. Alternatively, FIG. 7 illustrates the alternative use of a setscrew 76 in the positioning and securing of the sleeve 60 in the housing 70.

An embodiment of the invention as shown in FIG. 4 incorporates an end member 80, comprised of an outer surface 81 larger that the aperture 52 of the flange 50, an inner surface 82 sized to allow the passage of the strand 19, a front portion 83, and a rear portion 84. In an embodiment of the invention the front portion of inner surface 82 includes chamfer 85. In the preferred embodiment the front portion 83 of the end member 80 is secured against the rear portion 74 of the housing 70. Such attachment of the end member 80 to the housing 70 may be achieved, for example, by incorporating a weld along chamfer surface 75 and the front portion 83 of the end member 80.

Figure 8:
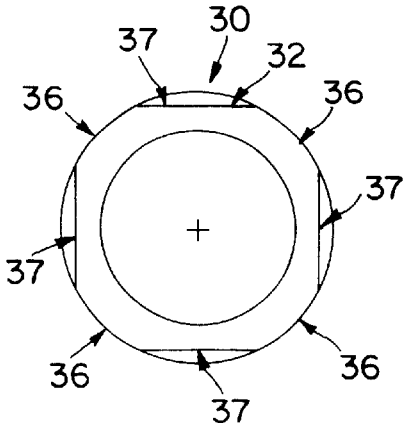
FIG. 8 is a frontal view of the detensioning apparatus outer housing in the preferred embodiment of the apparatus.

FIG. 8 illustrates a frontal view of a preferred embodiment of the outer housing 30. The front sleeve's outer surface 32 is comprised of flat surfaces 37 and rounded corners 36, that reduces the size of the outer surface 32 and prevents interference with neighboring strand chuck barrels, thereby allowing placement of the detensioning device in position over a single strand chuck barrel even within a group of chuck barrels.

Figure 9:
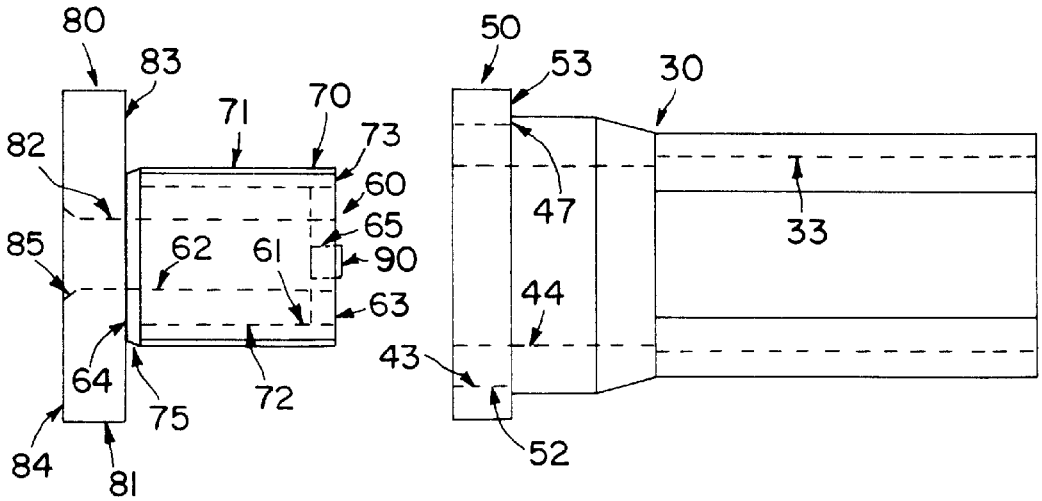
FIG. 9 is a longitudinal view of the two-piece detensioning device in the preferred embodiment of the apparatus.

An embodiment of the invention as a two piece apparatus is illustrated in FIG. 9. Magnet 90 is shown inserted into the cavity 65 of the sleeve 60, which is engaged with the housing 70. Housing 70 is also shown attached at the rear portion 75 to the front portion 83 of the end member 80. Flange 50 is also shown overlapping the rear step 43 of the outer housing 30, with the front portion 53 of flange 50 butting against rear shoulder 47.

Figure 10:
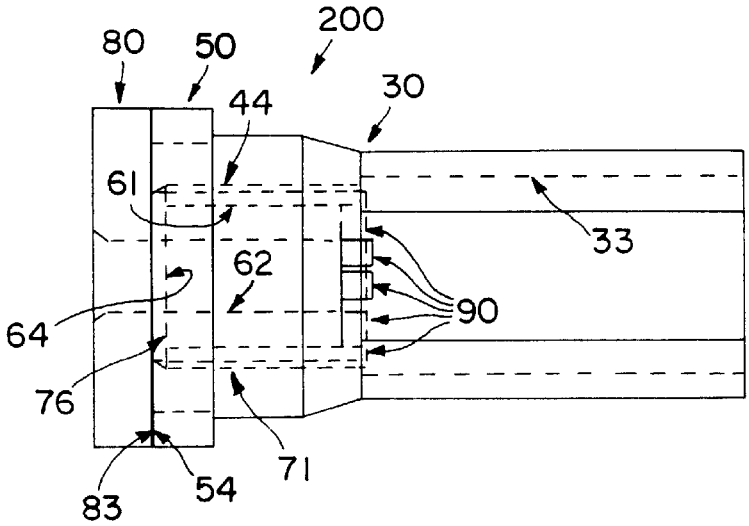
FIG. 10 is a longitudinal view of the engagement of the two piece detensioning device embodiment.

FIG. 10 illustrates a preferred embodiment of the invention in a completed assembly. The outer housing 30-second aperture 44 overlaps the housing 70, with the end member 80 front portion 83 butting against the rear portion 54 of the flange 50. Magnet 90 protrudes into the first aperture 33 of the outer housing 30, thus allowing for the extension of the magnet 90 into a strand chuck barrel 20, as shown in FIG. 12.

Figure 11:
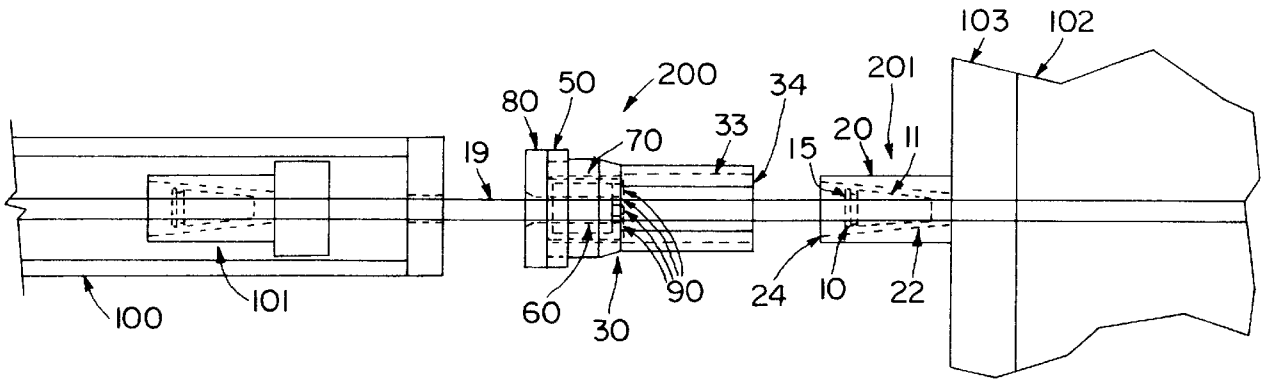
FIG. 11 is a longitudinal view of a portion of the hydraulic ram, the detensioning device, a chuck and strand chuck barrel exerting tensional force on a strand running through a prestressed concrete structure in the preferred embodiment.
Figure 12:
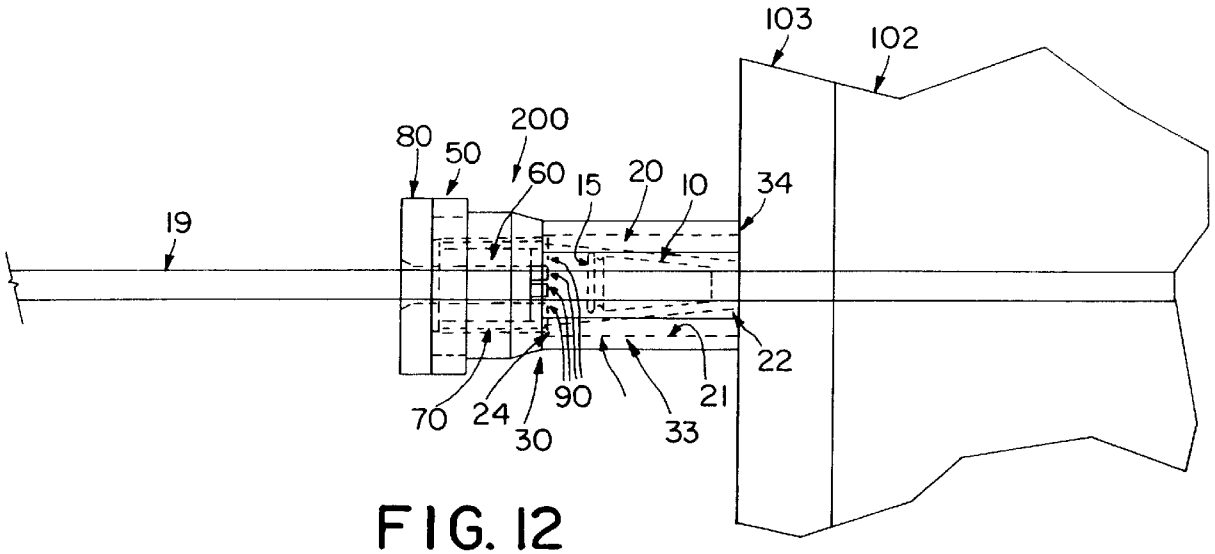
FIG. 12 is a longitudinal view of the detensioning device overlapping a clamp that is exerting tensional force on the strand of the prestressed concrete structure in the preferred embodiment.

A preferred embodiment of the invention as incorporated into the detensioning procedure is shown in FIGS. 11, 12 and 14. Strand 19 is secured by a dead end abutment (not shown) and a live end abutment 103. It is to be understood that the term "abutment" is being used in this application, to refer to the end structures whether of a self-stressing prestress casting bed (Type 1) or an abutment anchorage prestress casting bed (Type 2), opposing ones through which the strands are passed and against which the clamps bear when tension is applied. Chuck 10 is shown engaged within the conical inner surface 22 of the strand chuck barrel 20, resulting in clamp 201, said strand chuck barrel 20 being butted against abutment 103. Concrete will be poured into region 102, once the tensioning strands have been positioned and suitably tensioned as dictated by the requirements of the particular application. When re-tensioning or removal of the strand is required, detensioning device 200 is positioned over the strand 19 protruding from the abutment 103. A hydraulic ram 100 apparatus, which incorporates a secondary clamp assembly 101 is subsequently placed over the strand 19.

Detensioning device 200 is positioned so that the strand chuck barrel is overlapped by the first aperture 33, and the rear portion 24 of the strand chuck barrel 20 abuts against the front portion 45 of the outer housing's 30 rear sleeve 40, thereby allowing the magnet 90 to protrude into the conical inner surface 22 as shown in FIG. 12. The hydraulic ram then pulls upon the secondary chuck apparatus, bringing the strand 19 to full tension, balancing the tension in the strand between the chucks at the live and dead end abutments, while allowing the worker to stand away from the loaded strand in a relatively safe position. As will be discussed in further detail herein, additional tension is then applied to the strand, so as to create an additional extension of the strand. The effect of this additional extension serves to pull the portion of the strand, into which the one or more jaws of the chuck are now embedded, away from the conical inside surface of the chuck barrel. Preferably, the depth of the inside bore of detensioning device 200, which surrounds the chuck barrel is sized so that about ¾ of an inch of additional extension, brings the one or more jaws into physical contact with the magnet(s) 90. Preferably, the magnet(s) will be powerful enough to break the adhesion forces between the one or more jaws and the strand. Thus, when the additional tension is released, the one or more jaws will remain magnetically held to detensioning device 200.

Once the forces exerted by the hydraulic ram 100 are removed, the secondary clamp assembly 101 and hydraulic ram 100 are safely removed form the strand 19. This enables the withdrawal of the detensioning device 200 from the strand 19, and subsequently the slide-able removal of the chuck 10 and the strand chuck barrel 20 from the strand 19. The strand 19 may then be re-positioned relative to abutment 103, if needed, and retensioned, using the tensioning procedure previously described. FIG. 14 illustrates the detensioning process, in which the upper portion of FIG. 14, shows the detensioning device 200 in position, with the temporary chuck and ram in position behind the detensioning device. The lower portion of FIG. 14 shows the set up, after the additional force has been applied accomplishing the additional extension. The jaws of the chuck are shown, having moved to the left and in contact with the magnets, while the chuck barrel has remained in place. Upon release of the additional force, the strand will relax toward the right, but the jaw(s) will remain in place against the magnets of the detensioning device.

As mentioned previously, after the tension that has originally been applied to a strand has been balanced, additional tension is required, to create the additional extension needed to cause sufficient movement of the strand portion, to which the one or more jaws of the chuck are adhered, to move away from the chuck barrel and contact the magnet(s), to cause separate of the one or more jaws from the strand. Because of the need for this additional tension and extension, this detensioning device and procedure may not be used on all concrete casting operations. Specifically, the device and procedure are applicable to long casting operations, because the long lengths of strand are more capable of accommodating the additional strain (stretch) needed. Generally stated, as the lengths of the strands gets shorter and shorter, for a given strand and wire diameter and material, there is less and less available strain, so that for a minimum strand length, the amount of tension and strain required approaches the failure load of the particular strand.

In engineering terms:

$$\Delta L=(P\times L)/(A\times E) \quad \text{(Equation 1)}$$

Where:

ΔL=elongation, inches

P=Force (tension), pounds

L=Length of Prestress Concrete Casting Bed, inches

A=Area of Prestressing Strand, inches$^2$

E=Modulus of elasticity of Strand, pounds per square inch and, $$P=\phi\times A_s\times f_{pu} \quad \text{(Equation 2)}$$

Where:

P=Force (tension), pounds $\phi$=Reduction factor, percentage $A_s$=Area of Prestressing Strand, inches$^2$ $f_{pu}$=Bursting Strength of Prestressing Strand, 270,000 psi, min.

For example, the strand will fail when the ϕ factor equals 100%, per equation 2.

For a typical 0.5 inch diameter (0.153 in.$^2$ cross-sectional area), low-relaxation prestressing strand, a typical minimum tensile load guaranteed by a typical manufacturer is $$P=(1.0)\times(0.153\text{ in.}^2)\times(270{,}000\text{ psi})=41{,}300\text{ lb}$$

Slight variations will occur as the area and Modulus of Elasticity values of the strand vary.

Typically in the design of prestressed concrete applications, the ϕ-factor ranges 65%–75%. Therefore (in some equations, units are omitted, but are understood to be as set forth above):

$$P_{typical}=0.75\times(0.153)\times(270{,}000)=31{,}000\text{ lb (for 0.5" dia., low-relaxation strand)}$$

The corresponding strand elongation for a 425 foot long prestressing casting bed, using strand with a Modulus of Elasticity of 28,500,000 psi will be $$\Delta L=\{(31{,}000)\times(425\times12\text{ in.})\}/\{(0.153)\times(28{,}500{,}000)\}=36.25\text{ in.}$$

Equation 2 may be rewritten as follows:

$$P=(\Delta L\times A\times E)/L$$

Thus, using the example above, $$P=\{(0.75)(0.153)(28{,}500{,}000)\}/(425\times12)=640\text{ lb.},$$

wherein P is given for an additional extension of 0.75 inches, being the distance that is required to additionally extend the strand, to make the jaw(s) of the chuck contact the magnets.

Therefore, the total load on the strand required for appropriate operation of the detensioning device, on a 425 foot long prestressed concrete casting bed is 31,640 lb. (31,000 lb.+640 lb. for the 0.75 in. extension). This is 76.6% of the strand's bursting strength ($f_{pu}$).

If the prestressing bed is relatively short, e.g., 75 ft, the amount of additional tension required for the detensioning device to function is $$P=(3/4)(0.153)(28{,}500{,}000)/(75\times12)=3{,}640\text{ lb}$$

Therefore, the total load on the strand is 34,640 lb or 83.9% of the strand's bursting strength.

It is believed that the ϕ-factor and resulting tensile load may be taken up to 90% or 37,200 lb., respectively, and still maintain an adequate margin of safety. As a practical matter, for safety reasons, it is believed prudent to employ the detensioning device on prestressed casting beds whose length, and strand characteristics will allow for the force required to create the ¾" additional extension, without exceeding a tensile load of, e.g., 36,000. Depending upon the type of strand being detensioned, the preliminary limiting length of a casting bed may be on the order of any length greater than 75–80 feet.

The foregoing examples are provided by way of illustration and are not intended to limit the scope of the invention. It is to be understood that the numerical values that have been calculated are provided relative to the presumed values given.

The foregoing description and drawings merely explain and illustrate the invention and is not limited thereto except insofar as the appended claims are so limited, as those skilled in the art having the disclosure before them will be able to make modifications and variations therein without departing from the scope of the invention.

What is claimed is:

1. A detensioning apparatus, for use during a process of fabricating prestressed concrete, during which process a region in which concrete is to be poured includes at least two opposing abutments, and one or more prestressing strands are run between opposing abutments, tensioned and held in tension, by clamps that engage the strands and bear against the opposing abutments, while concrete is poured into the region and cured, wherein each clamp includes a chuck having one or more jaws, and a surrounding strand chuck barrel, configured so that tension in the strand, between opposing abutments, prompts the one or more jaws of the chuck to be pressed against the strand to frictionally engage the strand, while preventing movement of the strand in a first direction relative to the strand clamp;

the detensioning apparatus comprising:

a collar member, operably configured to be placed onto a prestressing strand that has been tensioned and to which a strand clamp is affixed, the collar member having a central bore, a first portion of which is operably configured to surround and insertingly receive the strand chuck barrel of the strand clamp which is affixed to the prestressing strand, and a second portion of which is provided with a smaller inner diameter than the first portion, defining a shoulder configured to bear against at least a portion of an end of the strand chuck barrel of the strand clamp which is affixed to the prestressing strand;

a separation member housing, operably configured to be insertingly received in the second portion of the central bore of the collar member;

at least one separation member supported on the separation member housing, and operably configured for separating a chuck from a prestressing strand, after the tension in the strand causing the chuck to be prompted against the strand is balanced, to permit movement of the strand in the first direction and in a second direction relative to the one or more chuck jaws, said second direction being substantially opposite to the first direction;

the collar member being operably configured to be slid onto a free end of a prestressing strand, to a position surrounding a strand chuck barrel that is holding a strand in tension, such that upon exertion of tension between a free end of the strand and a strand chuck barrel, the collar member bears against the strand chuck barrel and prevents its movement, so that additional tension in the strand will cause the chuck to be drawn toward the at least one separation member contained within the collar member.

2. A detensioning apparatus, for use during a process of fabricating prestressed concrete, during which process a region in which concrete is to be poured includes at least two opposing abutments, one or more prestressing strands are run between opposing abutments, tensioned and held in tension, by clamps that engage the strands and bear against the opposing abutments, while concrete is poured into the region and cured;

wherein each clamp includes a chuck having one or more jaws, and a surrounding strand chuck barrel, configured so that tension in the strand, between opposing abutments, prompts the chuck to be pressed against the strand to frictionally engage the strand;

the detensioning apparatus comprising:

a collar member, operably configured to be placed onto a prestressing strand, that has been tensioned and to which a strand clamp has been affixed, the collar member having a central bore, a first portion of which is operably configured to insertingly receive a strand chuck barrel, and a second portion of which is provided with a smaller inner diameter than the first portion, defining a shoulder configured to bear against at least a portion of an end of a strand chuck barrel;

a separation member housing, operably configured to be insertingly received in the second portion of the central bore of the collar member;

at least one separation member supported on the separation member housing, and operably configured for separating a chuck from a prestressing strand, after the tension in the strand causing the chuck to be prompted against the strand is balanced;

the collar member being operably configured to be slid onto a free end of a prestressing strand, to a position surrounding a strand chuck barrel that is holding a strand in tension, such that upon exertion of tension between a free end of the strand and a strand chuck barrel, the collar member bears against the strand chuck barrel and prevents its movement, so that additional tension in the strand will cause the chuck to be drawn toward the at least one separation member contained within the collar member;

the chuck of the strand clamp being fabricated at least in part, from magnetically responsive material, the at least one separation member further comprising:

at least one magnetic member mounted on the separation member housing, so as to exert magnetic force on the one or more jaws, when the additional tension is applied to the strand the one or more jaws move with the strand until they come into contact with the at least one separation member, the at least one separation member holding the one or more jaws, allowing the strand to slide through the one or more jaws, thereby detensioning the strand.

3. The detensioning apparatus according to claim 1, wherein the separation member housing comprises a first cylindrical member, having a central bore, for receiving a prestressing strand;

the first cylindrical member having a diameter less than the diameter of the second portion of the central bore of the collar member, to enable insertion of the first cylindrical member into the second portion of the central bore of the collar member;

the first cylindrical member further having a first end operably configured to support the at least one separation member, at a position proximate an outer end of the first portion of the central bore of the housing member.

4. The detensioning apparatus according to claim 3, wherein the first end of the first cylindrical member is provided with at least one cavity operably configured to receive the at least one separation member.

5. A detensioning apparatus, for use during a process of fabricating prestressed concrete, during which process a region in which concrete is to be poured includes at least two opposing abutments, one or more prestressing strands are run between opposing abutments, tensioned and held in tension, by clamps that engage the strands and bear against the opposing abutments, while concrete is poured into the region and cured;

wherein each clamp includes a chuck having one or more jaws, and a surrounding strand chuck barrel, configured so that tension in the strand, between opposing abutments, prompts the chuck to be pressed against the strand to frictionally engage the strand;

the detensioning apparatus comprising:

a collar member, operably configured to be placed onto a prestressing strand, that has been tensioned and to which a strand clamp has been affixed, the collar member having a central bore, a first portion of which is operably configured to insertingly receive a strand chuck barrel, and a second portion of which is provided with a smaller inner diameter than the first portion, defining a shoulder configured to bear against at least a portion of an end of a strand chuck barrel;

a separation member housing, operably configured to be insertingly received in the second portion of the central bore of the collar member;

at least one separation member supported on the separation member housing, and operably configured for separating a chuck from a prestressing strand, after the tension in the strand causing the chuck to be prompted against the strand is balanced;

the collar member being operably configured to be slid onto a free end of a prestressing strand, to a position surrounding a strand chuck barrel that is holding a strand in tension, such that upon exertion of tension between a free end of the strand and a strand chuck barrel, the collar member bears against the strand chuck barrel and prevents its movement, so that additional tension in the strand will cause the chuck to be drawn toward the at least one separation member contained within the collar member;

the separation member housing further comprising a first cylindrical member, having a central bore, for receiving a prestressing strand;

the first cylindrical member having a diameter less than the diameter of the second portion of the central bore of the collar member, to enable insertion of the first cylindrical member into the second portion of the central bore of the collar member;

the first cylindrical member further having a first end operably configured to support the at least one separation member, at a position proximate an outer end of the first portion of the central bore of the housing member;

the separation member housing further comprising a second cylindrical member, having a central bore operably configured to receive the first cylindrical member, the second cylindrical member having an outer diameter operably configured to enable, at least a first end portion of the second cylindrical member to be insertingly received, at least in part, in the second portion of the central bore of the collar member.

6. The detensioning apparatus according to claim 5, wherein the separation member housing further comprises a first attachment flange, operably connected to a second end of the second cylindrical member, and having an outer diameter greater than the diameter of the second portion of the central bore of the collar member, the attachment flange further having a central bore for enabling the passage therethrough of a prestressing strand.

7. The detensioning apparatus according to claim 6, further comprising a second attachment flange, operably mounted on and having an outer diameter greater than, the collar member, for enabling abutment of the first attachment flange to the second attachment flange, upon insertion of the separation member housing into the second portion of the central bore of the collar member, whereupon affixation of the second attachment flange to the first attachment flange affixes the separation member housing to the collar member.

8. The detensioning apparatus according to claim 1, wherein at least a portion of an outer surface of the collar member is provided with flattened sides, for facilitating placement of the detensioning device in position over a strand chuck barrel and against an abutment.

9. A method for detensioning a prestressing strand, for use during a process of fabricating prestressed concrete, during which process a region in which concrete is to be poured includes at least two opposing abutments, and one or more prestressing strands are run between opposing abutments, tensioned and held in tension, by clamps that engage the strands and bear against the opposing abutments, while concrete is poured into the region and cured;

wherein each clamp includes a chuck having from one or more jaws and a surrounding strand chuck barrel, configured so that tension in the strand, between opposing abutments, prompts the one or more jaws of the chuck to be pressed against the strand to frictionally engage the strand, while preventing movement of the strand in a first direction relative to the strand clamp;

positioning a detensioning apparatus onto a prestressing strand that has been tensioned and to which a strand clamp is affixed, the detensioning apparatus including a collar member, operably configured to be placed onto a prestressing strand, that has been tensioned and to which a strand clamp is affixed, the collar member having a central bore, a first portion of which is operably configured to surround and insertingly receive the strand chuck barrel of the strand clamp which is affixed to the prestressing strand, and a second portion of which is provided with a smaller inner diameter than the first portion, defining a shoulder configured to bear against at least a portion of an end of the strand chuck barrel of the strand clamp which is affixed to the prestressing strand;

a separation member housing, operably configured to be insertingly received in the second portion of the central bore of the collar member;

at least one separation member supported on the separation member housing, and operably configured for separating a chuck from a prestressing strand, after the tension in the strand causing the chuck to be prompted against the strand is balanced, to permit movement of the strand in the first direction and in a second direction relative to the one or more chuck jaws, said second direction being substantially opposite to the first direction;

the collar member being operably configured to be slid onto a free end of a prestressing strand, to a position surrounding a strand chuck barrel that is holding a strand in tension, such that upon exertion of tension between a free end of the strand and a strand chuck barrel, the collar member bears against the strand chuck barrel and prevents its movement, so that additional tension in the strand will cause the chuck to be drawn toward the at least one separation member contained within the collar member;

sliding the collar member onto a free end of a prestressing strand, to a position surrounding a strand chuck barrel, and affixing the detensioning apparatus against an abutment;

pulling on a free end of the prestressing strand, until the tension in the strand that causes the chuck to be prompted against the prestressing strand has been balanced;

applying additional tension in the strand, to cause the chuck to be drawn toward the at least one separation member contained within the collar member;

whereupon the at least one separation member causes the chuck to become separated from the strand, to enable repositioning of the prestressing strand and/or the strand clamp.

10. A method for detensioning a prestressing strand, for use during a process of fabricating prestressed concrete, during which process a region in which concrete is to be poured includes at least two opposing abutments, one or more prestressing strands are run between opposing abutments, tensioned and held in tension, by clamps that engage the strands and bear against the opposing abutments, while concrete is poured into the region and cured;

wherein each clamp includes a chuck having from one or more jaws and a surrounding strand chuck barrel, configured so that tension in the strand, between opposing abutments, prompts the chuck to be pressed against the strand to frictionally engage the strand;

positioning a detensioning apparatus onto a prestressing strand, which strand has been tensioned and to which a strand clamp has been affixed, the detensioning apparatus including a collar member, operably configured to be placed onto a prestressing strand, that has been tensioned and to which a strand clamp has been affixed, the collar member having a central bore, a first portion of which is operably configured to insertingly receive a strand chuck barrel, and a second portion of which is provided with a smaller inner diameter than the first portion, defining a shoulder configured to bear against at least a portion of an end of a strand chuck barrel;

a separation member housing, operably configured to be insertingly received in the second portion of the central bore of the collar member;

at least one separation member supported on the separation member housing, and operably configured for separating a chuck from a prestressing strand, after the tension in the strand causing the chuck to be prompted against the strand is balanced;

the collar member being operably configured to be slid onto a free end of a prestressing strand, to a position surrounding a strand chuck barrel that is holding a strand in tension, such that upon exertion of tension between a free end of the strand and a strand chuck barrel, the collar member bears against the strand chuck barrel and prevents its movement, so that additional tension in the strand will cause the chuck to be drawn toward the at least one separation member contained within the collar member;

sliding the collar member onto a free end of a prestressing strand, to a position surrounding a strand chuck barrel, and affixing the detensioning apparatus against an abutment;

pulling on a free end of the prestressing strand, until the tension in the strand that causes the chuck to be prompted against the prestressing strand has been balanced;

applying additional tension in the strand, to cause the chuck to be drawn toward the at least one separation member contained within the collar member;

whereupon the at least one separation member causes the chuck to become separated from the strand, to enable repositioning of the prestressing strand and/or the strand clamp;

the chuck of the strand clamp being fabricated, at least in part, from magnetically responsive material, the method further comprising the step of fabricating the at least one separation member as at least one magnetic member mounted on the separation member housing, so as to exert magnetic force on the one or more jaws, when the additional tension is applied to the strand the one or more jaws move with the strand until they come into contact with the at least one separation member, the at least one separation member holding the one or more jaws, allowing the strand to slide through the one or more jaws, thereby detensioning the strand.

11. The method according to claim 9, further comprising the step of fabricating the separation member housing as a first cylindrical member, having a central bore, for receiving a prestressing strand, the first cylindrical member having a diameter less than the diameter of the second portion of the central bore of the collar member, to enable insertion of the first cylindrical member into the second portion of the central bore of the collar member, the first cylindrical member further having a first end operably configured to support the at least one separation member, at a position proximate an outer end of the first portion of the central bore of the housing member.

12. The method according to claim 11, further comprising the step of providing the first end of the first cylindrical member with at least one cavity operably configured to receive the at least one separation member.

13. A method for detensioning a prestressing strand, for use during a process of fabricating prestressed concrete, during which process a region in which concrete is to be poured includes at least two opposing abutments, one or more prestressing strands are run between opposing abutments, tensioned and held in tension, by clamps that engage the strands and bear against the opposing abutments, while concrete is poured into the region and cured, wherein each clamp includes a chuck having from one or more jaws and a surrounding strand chuck barrel, configured so that tension in the strand, between opposing abutments, prompts the chuck to be pressed against the strand to frictionally engage the strand, positioning a detensioning apparatus onto a prestressing strand, which strand has been tensioned and to which a strand clamp has been affixed, the detensioning apparatus including a collar member, operably configured to be placed onto a prestressing strand, that has been tensioned and to which a strand clamp has been affixed, the collar member having a central bore, a first portion of which is operably configured to insertingly receive a strand chuck barrel, and a second portion of which is provided with a smaller inner diameter than the first portion, defining a shoulder configured to bear against at least a portion of an end of a strand chuck barrel, a separation member housing, operably configured to be insertingly received in the second portion of the central bore of the collar member, at least one separation member supported on the separation member housing, and operably configured for separating a chuck from a prestressing strand, after the tension in the strand causing the chuck to be prompted against the strand is balanced, the collar member being operably configured to be slid onto a free end of a prestressing strand, to a position surrounding a strand chuck barrel that is holding a strand in tension, such that upon exertion of tension between a free end of the strand and a strand chuck barrel, the collar member bears against the strand chuck barrel and prevents its movement, so that additional tension in the strand will cause the chuck to be drawn toward the at least one separation member contained within the collar member, sliding the collar member onto a free end of a prestressing strand, to a position surrounding a strand chuck barrel, and affixing the detensioning apparatus against an abutment;

pulling on a free end of the prestressing strand, until the tension in the strand that causes the chuck to be prompted against the prestressing strand has been balanced, applying additional tension in the strand, to cause the chuck to be drawn toward the at least one separation member contained within the collar member, whereupon the at least one separation member causes the chuck to become separated from the strand, to enable repositioning of the prestressing strand and/or the strand clamp the method further comprising the step of fabricating the separation member housing as a first cylindrical member, having a central bore, for receiving a prestressing strand, the first cylindrical member having a diameter less than the diameter of the second portion of the central bore of the collar member, to enable insertion of the first cylindrical member into the second portion of the central bore of the collar member, the first cylindrical member further having a first end operably configured to support the at least one separation member, at a position proximate an outer end of the first portion of the central bore of the housing member, the method further comprising the step of providing the separation member housing with a second cylindrical member, having a central bore operably configured to receive the first cylindrical member, the second cylindrical member having an outer diameter operably configured to enable, at least a first end portion of the second cylindrical member to be insertingly received, at least in part, in the second portion of the central bore of the collar member.

14. The method according to claim 13, further comprising the step of operably connecting a first attachment flange, to a second end of the second cylindrical member, and having an outer diameter greater than the diameter of the second portion of the central bore of the collar member, the attachment flange further having a central bore for enabling the passage therethrough of a prestressing strand.

15. The method according to claim 14, further comprising the step of operably mounting a second attachment flange on the collar member, the second attachment flange having an outer diameter greater than, the collar member, for enabling abutment of the first attachment flange to the second attachment flange, upon insertion of the separation member housing into the second portion of the central bore of the collar member, whereupon affixation of the second attachment flange to the first attachment flange affixes the separation member housing to the collar member.

16. The method according to claim 9, further comprising the step of providing at least a portion of an outer surface of the collar member with flattened sides, for facilitating clamping of the detensioning device in position over a strand chuck barrel and against an abutment.

* * * * *